US010717309B2

(12) United States Patent
Iijima et al.

(10) Patent No.: US 10,717,309 B2
(45) Date of Patent: Jul. 21, 2020

(54) LIQUID DISCHARGE HEAD AND LIQUID DISCHARGE APPARATUS

(71) Applicant: TOSHIBA TEC KABUSHIKI KAISHA, Tokyo (JP)

(72) Inventors: Tomomi Iijima, Mishima Shizuoka (JP); Akimasa Toyama, Yokohama Kanagawa (JP); Naoaki Kiryu, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/352,076

(22) Filed: Mar. 13, 2019

(65) Prior Publication Data

US 2019/0315138 A1 Oct. 17, 2019

(30) Foreign Application Priority Data

Apr. 13, 2018 (JP) ..... 2018-077804

(51) Int. Cl.

| | |
|---|---|
| ***B41J 29/377*** | (2006.01) |
| ***B41J 2/14*** | (2006.01) |
| ***B41J 2/045*** | (2006.01) |
| ***B41J 2/18*** | (2006.01) |

(52) U.S. Cl.

CPC ..... *B41J 29/377* (2013.01); *B41J 2/0458* (2013.01); *B41J 2/14072* (2013.01); *B41J 2/14201* (2013.01); *B41J 2/18* (2013.01); *B41J 2002/14362* (2013.01); *B41J 2002/14491* (2013.01); *B41J 2202/08* (2013.01)

(58) Field of Classification Search

CPC ..... B41J 2/1408; B41J 2/3358; B41J 29/377; B41J 2202/08; B41J 2/04515

See application file for complete search history.

(56) References Cited

U.S. PATENT DOCUMENTS

| | | | | |
|---|---|---|---|---|
| 8,382,231 | B2 | 2/2013 | Takano et al. | |
| 8,789,912 | B2 | 7/2014 | Yamada et al. | |
| 9,415,592 | B2 | 8/2016 | Iijima | |
| 2019/0126649 | A1* | 5/2019 | Midorikawa | B41J 2/175 |
| 2019/0315120 | A1* | 10/2019 | Iijima | B41J 2/14 |

FOREIGN PATENT DOCUMENTS

| | | | |
|---|---|---|---|
| JP | H08-276575 | A | 10/1996 |
| JP | 2007-168112 | A | 7/2007 |

* cited by examiner

*Primary Examiner* — Julian D Huffman
(74) *Attorney, Agent, or Firm* — Kim & Stewart LLP

(57) ABSTRACT

A liquid discharge head includes a head, a liquid supply conduit, a liquid discharge conduit, a radiator, first and second wiring boards, and a heat conductive member. Liquid is supplied to the head for discharge through the liquid supply conduit. Liquid that passes through the head flows to the liquid discharge conduit. The radiator includes a flow path through which a coolant flows. The coolant is different from the liquid supplied to the head for discharge. The first wiring board is between the head and the radiator and has a connector connected to a wiring extending through an inner space of the radiator. The second wiring board is between the head main body and the first wiring board, and includes, thereon, a driving control element. The heat conductive member extends between the head and the radiator, and is in thermal contact with the radiator.

20 Claims, 13 Drawing Sheets

LIQUID DISCHARGE HEAD AND LIQUID DISCHARGE APPARATUS

CROSS-REFERENCE TO RELATED APPLICATION

This application is based upon and claims the benefit of priority from Japanese Patent Application No. 2018-077804, filed on Apr. 13, 2018, the entire contents of which are incorporated herein by reference.

FIELD

Embodiments described herein relate generally to a liquid discharge head and a liquid discharge apparatus.

BACKGROUND

An inkjet head, more generally referred to as a liquid discharge head, used in a printer or other liquid discharge apparatus has a head with a piezoelectric element for discharging ink, or other liquids, and a driving control integrated circuit (IC) for driving the piezoelectric element. A substrate, on which the driving control IC is mounted, or a substrate, on which an electronic component is mounted, is generally accommodated within an inner cover to prevent adhesion of ink or foreign matters to the substrate.

Heat generated by the driving control IC is transferred to the outside by the inner cover functioning as a heat sink. Thus, as the inner cover becomes physically larger, it dissipates more heat generated by the driving control IC. In recent years, the load of the driving control IC has been increasing due to increases in printing rates/speeds, and this has led to an increase in the amount of heat generated by the driving control IC. Considering overall limits on the acceptable size of the entire apparatus, the continued enlargement of the inner cover size to account for increases in heat generation has reached its limit.

DETAILED DESCRIPTION

Figure 1:
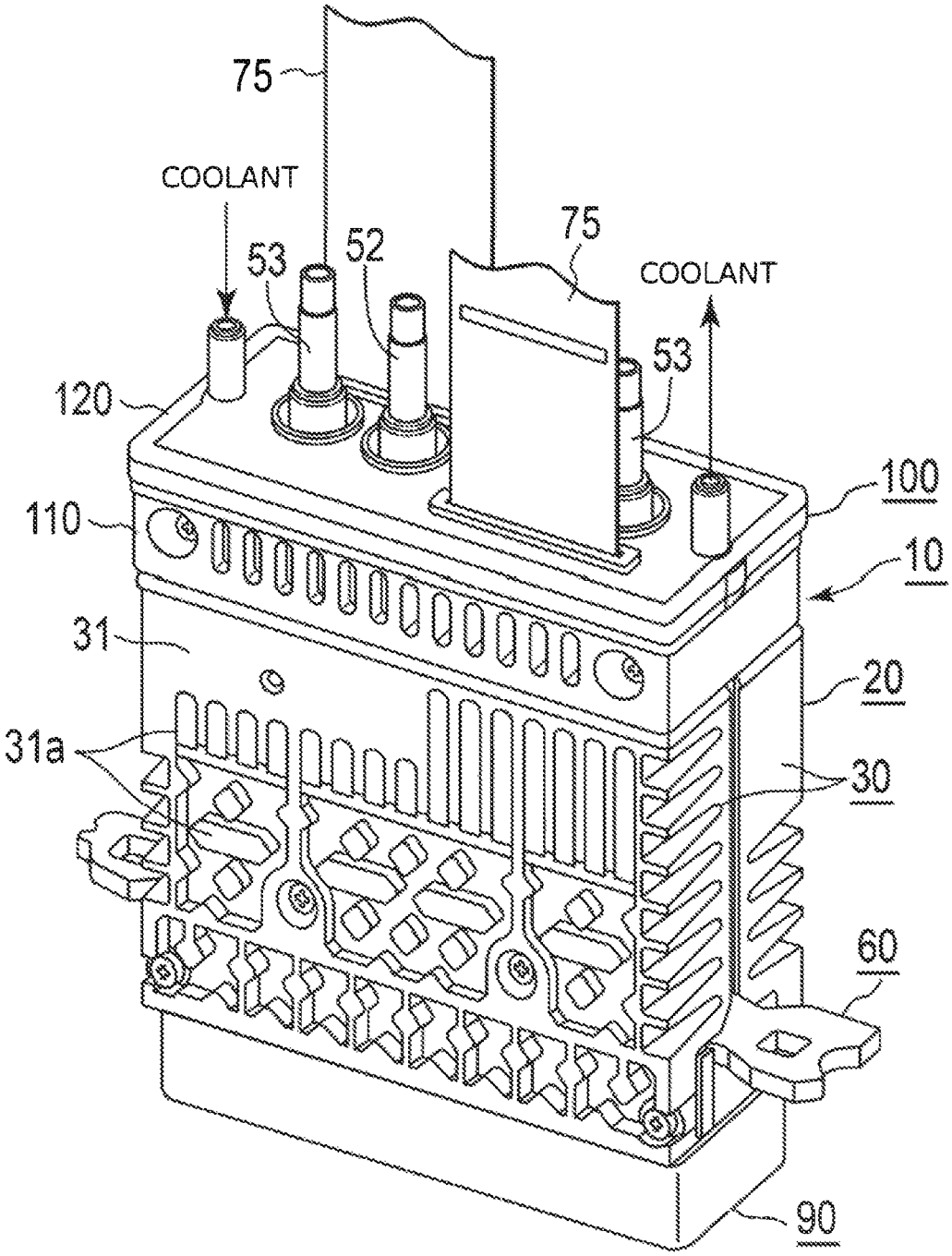
FIG. 1 illustrates a perspective view of an inkjet head according to a first embodiment.

Embodiments provide a liquid discharge head and a liquid discharge apparatus with improved cooling efficiency and stabilized temperature even when the amount of heat generated by the driving control integrated circuit (IC) increases.

In general, according to an embodiment, a liquid discharge head includes a head, a liquid supply conduit, a liquid discharge conduit, a radiator, a first wiring board, a second wiring board, and a heat conductive member. The head includes a plurality of discharge holes for discharging a liquid, such as an ink or otherwise. This liquid is supplied to the head through the liquid supply conduit. Liquid that passes through the head without being discharged from the discharge holes flows through the liquid discharge conduit. The radiator includes a flow path through which a coolant flows. The coolant is a liquid different from the liquid supplied to the head for discharge from the discharge holes. The first wiring board is between the head and the radiator and has a connector connected to a wiring extending through an interior of the radiator. The second wiring board is between the head main body and the first wiring board. A driving control element (for example, an integrated circuit or the like) is on the second wiring board and configured to control the liquid discharge from the discharge holes. The heat conductive member extends between the head and the radiator, and is in thermal contact with the radiator.

Hereinafter, example embodiments will be described with reference to accompanying drawings. In drawings, same reference numerals denote same elements. For the purpose of description, the drawings used for purposes of explanation of the embodiments may vary the scale of aspects depicted from those of actual devices and/or drawing to drawing.

First Embodiment

Figure 2:
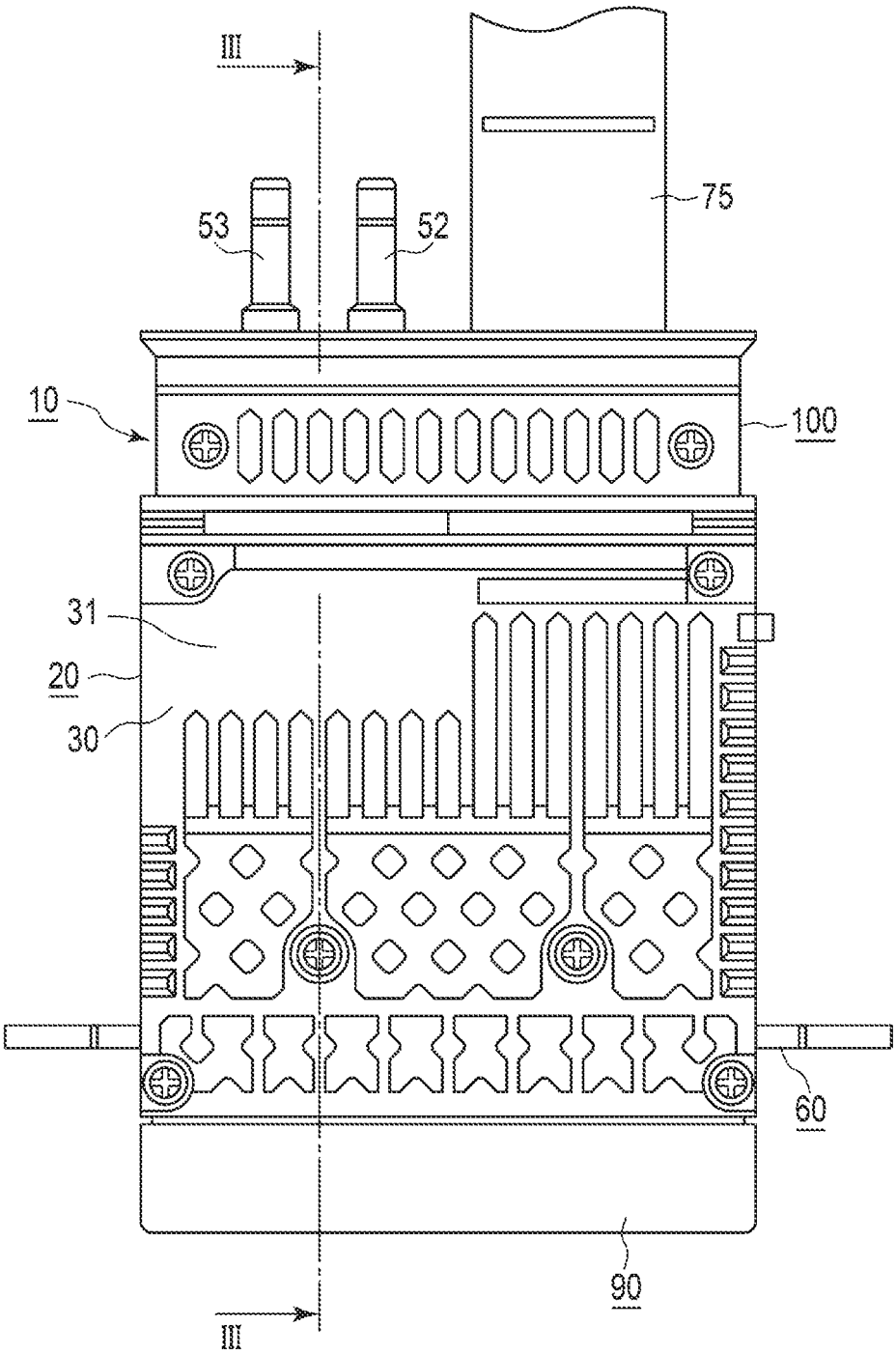
FIG. 2 illustrates a front view of the inkjet head.
Figure 3:
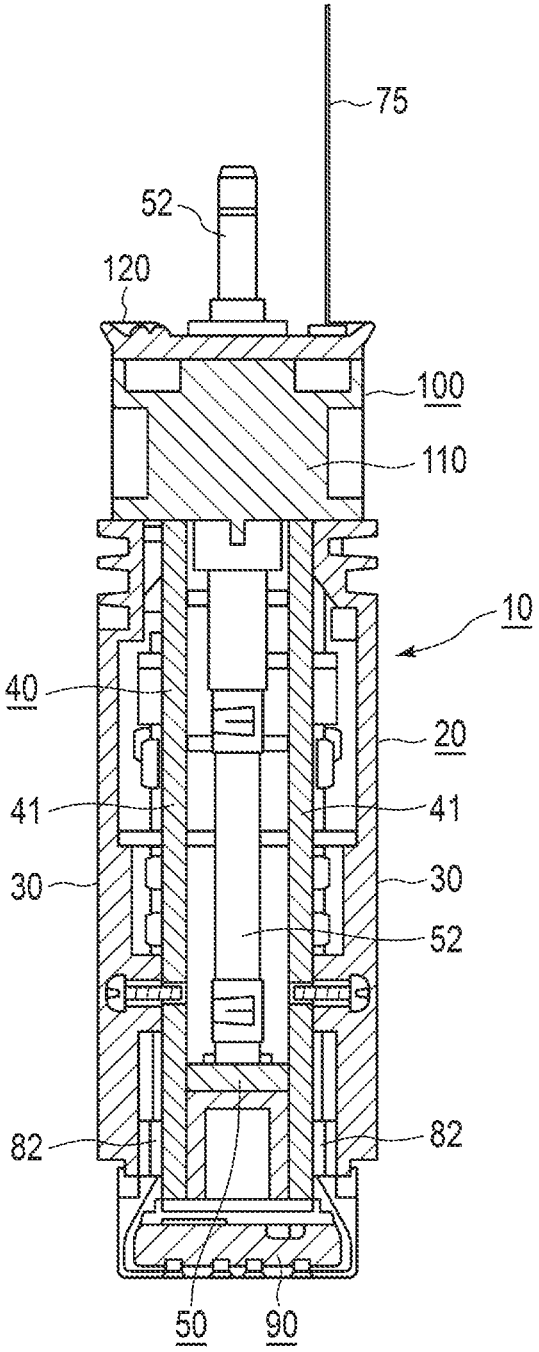
FIG. 3 illustrates a cross-sectional view of the inkjet head taken along a line III-III of FIG. 2 and viewed in arrow direction.
Figure 4:
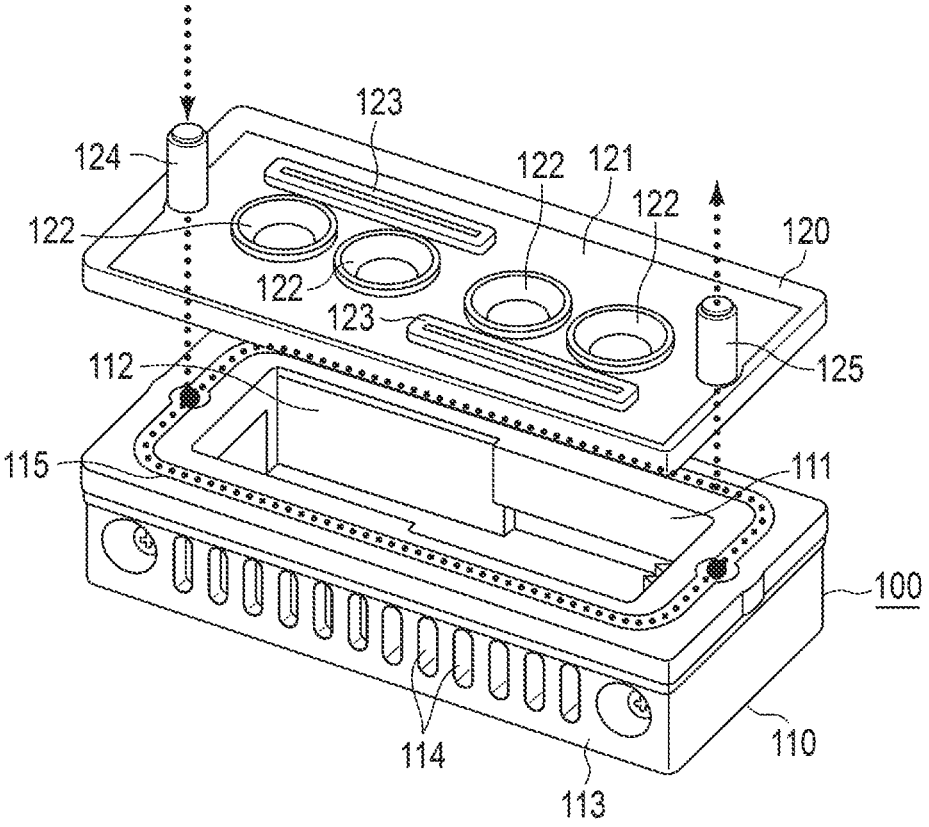
FIG. 4 illustrates an exploded perspective view of a cooling unit in the inkjet head.
Figure 5:
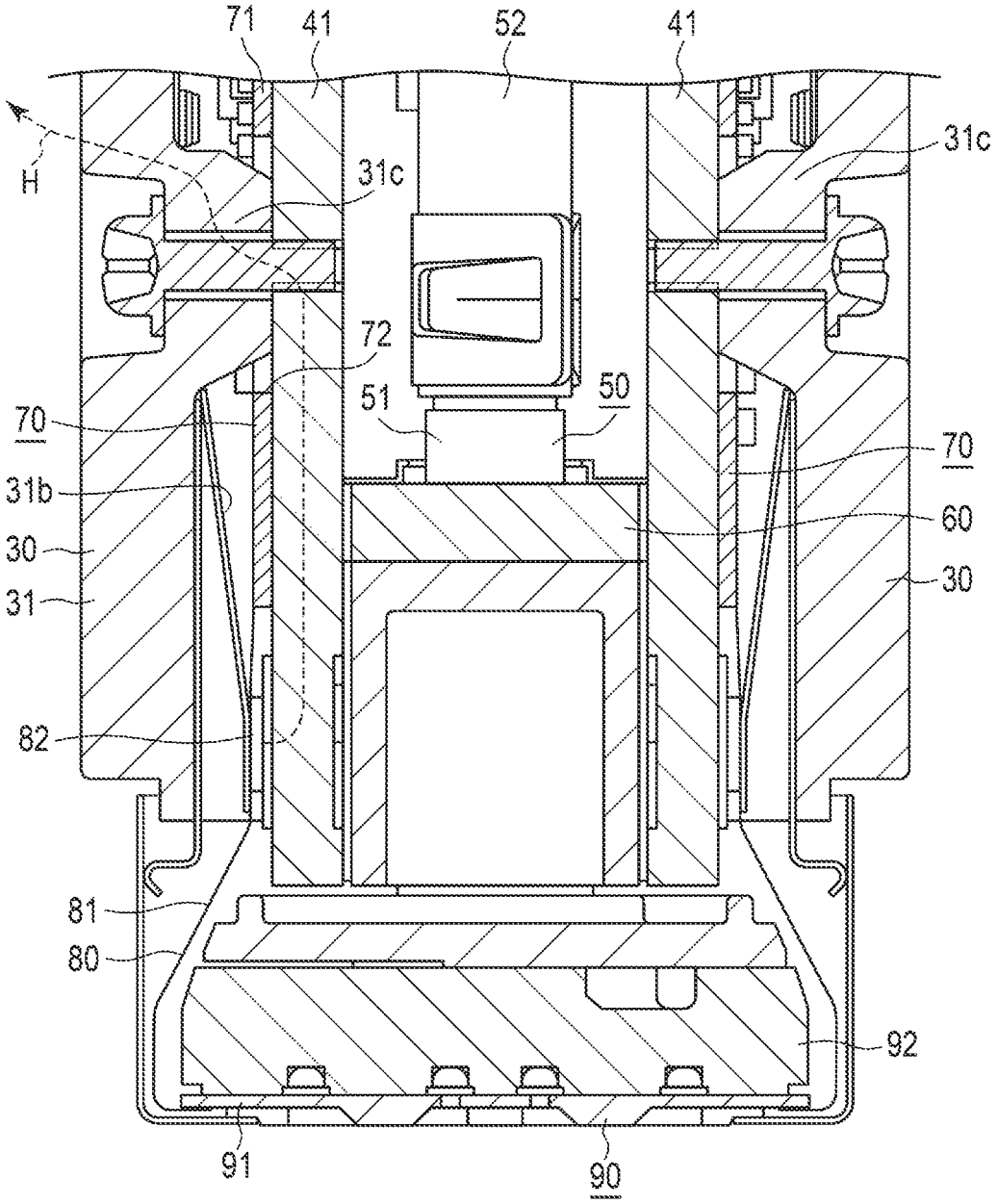
FIG. 5 illustrates a cross-sectional view of a main portion of the inkjet head.

Hereinafter, a printer 1, which may also be referred to as a liquid discharge apparatus 1, and an inkjet head 10, which may also be referred to as a liquid discharge head 10, according to an embodiment will be described. FIG. 1 illustrates a perspective view of the inkjet head 10. FIG. 2 illustrates a front view of the inkjet head 10. FIG. 3 illustrates a cross-sectional view of the inkjet head 10 taken along a line III-III of FIG. 2 and viewed in arrow direction. FIG. 4 illustrates an exploded perspective view of a cooling unit 100, which may also be referred to as a radiator 100, embedded in the inkjet head 10. FIG. 5 illustrates a cross-sectional view of a main portion of the inkjet head 10. FIGS. 6-10 each illustrate a perspective view of the inkjet head 10 to illustrate an assembly process of the inkjet head 100.

As illustrated in FIG. 1, the inkjet head 10 is an inkjet head connected to an ink duct 5.

The inkjet head 10 includes a head main body 20 and the cooling unit 100 disposed above the head main body 20. The head main body 20 includes a pair of side covers 30. The side cover 30 is formed, of, for example, an aluminum material having relatively high thermal conductivity.

A driving unit 40 is accommodated in the head main body 20 between side covers 30. Each side cover 30 includes a main plate 31 and a pair of side plates 32 integrally formed on both sides of the main plate 31. The main plate 31 and the side plates 32 include radiation fins 31*a* and 32*a*. Accordingly, the main plate 31 and the side plates 32 function as a heat sink. A leaf spring 31*b* biased inward and a protruding portion 31*c* are formed on an inner surface of the main plate 31. Instead of the leaf spring 31*b*, another elastic material such as silicon rubber may be used.

The driving unit 40 includes a pair of inner plates 41, which may each be referred to as a heat conductive member 41. An ink circulating unit 50 and a reference plate 60 are disposed between the inner plates 41. The inner plates 41 and the reference plate 60 are fixed by screws.

The ink circulating unit 50 includes four cylindrical connecting portions 51. An ink supply tube 52 and an ink discharge tube 53 are connected to the connecting portions 51.

The reference plate 60 is a member for fixing and positioning the inkjet head 10 to attach the inkjet head 10 to a printer main body. The reference plate 60 includes a plate 61. The plate 61 includes four opening holes 62. An outer periphery of the connecting portion 51 described above is fitted in the opening hole 62, and bonded and fixed.

Figure 9:
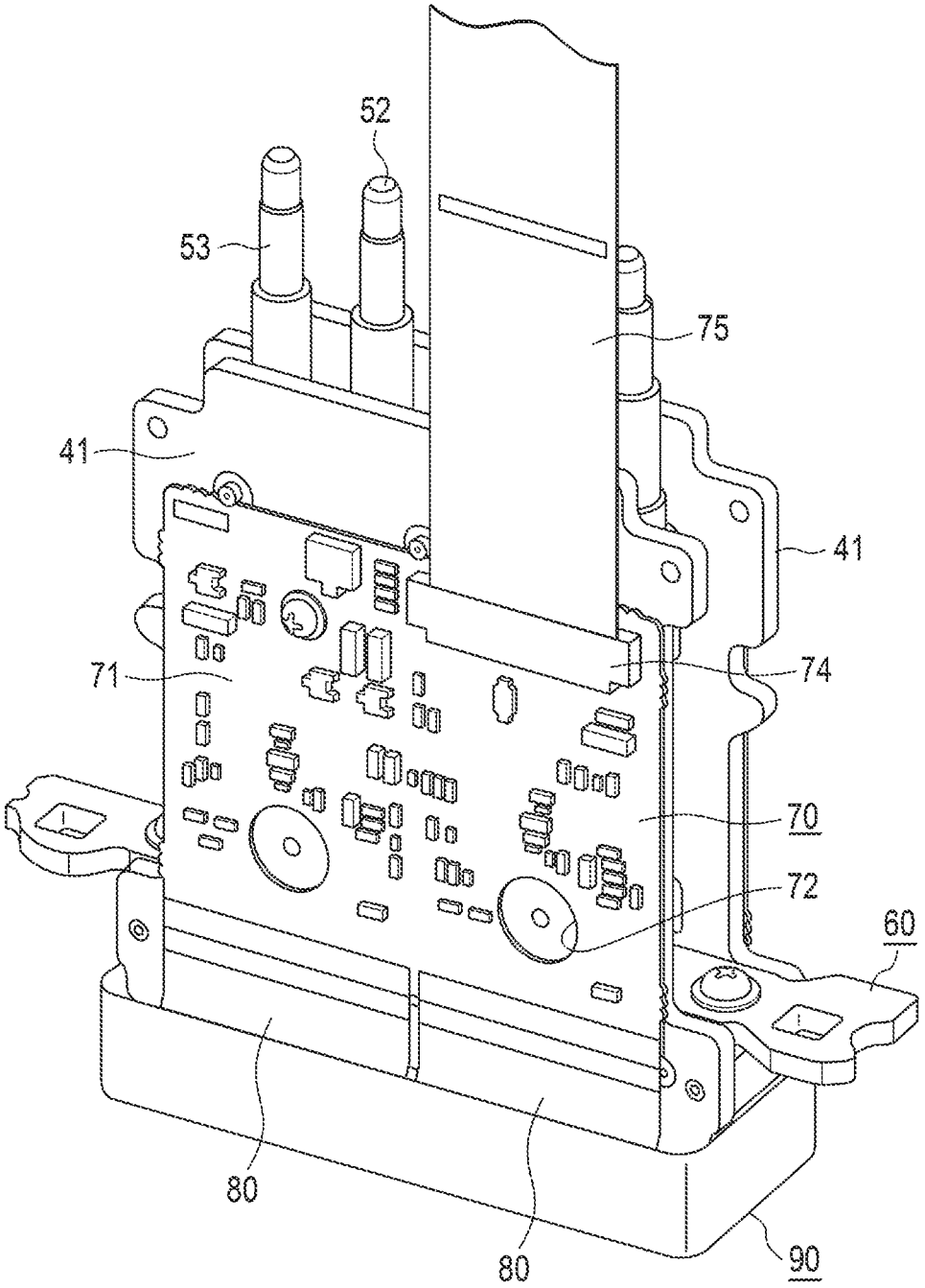

A printed wiring board 70 includes a substrate body 71. A hole portion 72 is formed on the substrate body 71. The hole portion 72 is formed above a driving control integrated circuit (IC) 82 described below. An insulating film 73 is attached to an outer surface of the substrate body 71. The substrate body 71 is fixed to the inner plate 41 via the insulating film 73. The insulating film 73 is, for example, a graphite sheet. A control element is mounted on the substrate body 71. A communication terminal 74 illustrated in FIG. 9 is used for communication with a control unit 2, and a flat cable 75 is connected to the communication terminal 74.

As illustrated in FIG. 5, a wiring film 80 is disposed below the printed wiring board 70. The wiring film 80 includes a flexible film base 81 and may be referred to as a substrate 80 in some contexts. Wires connected to signal lines are provided on the film base 81. The driving control IC 82 is mounted inside the film base 81. A surface of the driving control IC 82 opposite to the wiring film 80 is connected to the inner plate 41 with the insulating film 73 therebetween.

The printed wiring board 70 is connected to an upper end of the wiring film 80, and a head plate 91 described below is connected to a lower end.

A discharge unit 90 is provided at a lower portion of the head main body 20. The head plate 91 (also referred to as a head main body 91, is disposed at a lowermost end of the discharge unit 90. A discharge hole for discharging ink and a pressure chamber are both formed in the head plate 91. Wiring of the wiring film 80 for driving the pressure chamber is connected to each pressure chamber.

The driving control IC 82 is pressed from the main plate 31 towards the inner plate 41 by an elastic body (leaf spring, silicon rubber, or the like) to contact the inner plate 41, and heat generated by the driving control IC 82 is transmitted to the inner plate 41.

The head plate 91 is in contact with a manifold 92 on a top surface thereof. The manifold 92 includes a flow path communicating with the pressure chamber to supply and discharge ink. A connecting portion to which an ink supply tube and an ink discharge tube are connected is adhered to the manifold 92.

The cooling unit 100 includes a housing 110 having a rectangular frame shape, and a top cover 120 covering an upper surface side. Both the housing 110 and the top cover 120 are formed of a material having high thermal conductivity, such as aluminum, magnesium, or ceramic.

A recessed portion 112 is formed on an inner wall surface 111 of the housing 110. An upper end portion of the inner plate 41 described above is in contact with the inner wall surface 111. The flat cable 75 is positioned in the recessed portion 112. Cooling fins 114 are formed on an outer wall surface 113 of the housing 110. A flow path 115 through which coolant flows is formed inside the housing 110. The flow path 115, which may be a groove in some examples, is covered with a plate 121. As the coolant, an antifreeze solution obtained by mixing glycerin, or the like, with distilled water can be used.

The top cover 120 includes the plate-shaped plate 121. The plate 121 includes holes 122 through which two sets of ink supply tubes 52 and ink discharge tubes 53 pass. A slit hole (slot) 123 through which the flat cable 75 passes is formed. In addition, a coolant inlet port 124 and a coolant outlet port 125 are formed and connected to the flow path 115. Coolant supplied from the coolant inlet port 124 passes through the flow path 115 and is discharged from the coolant outlet port 125.

Figure 6:
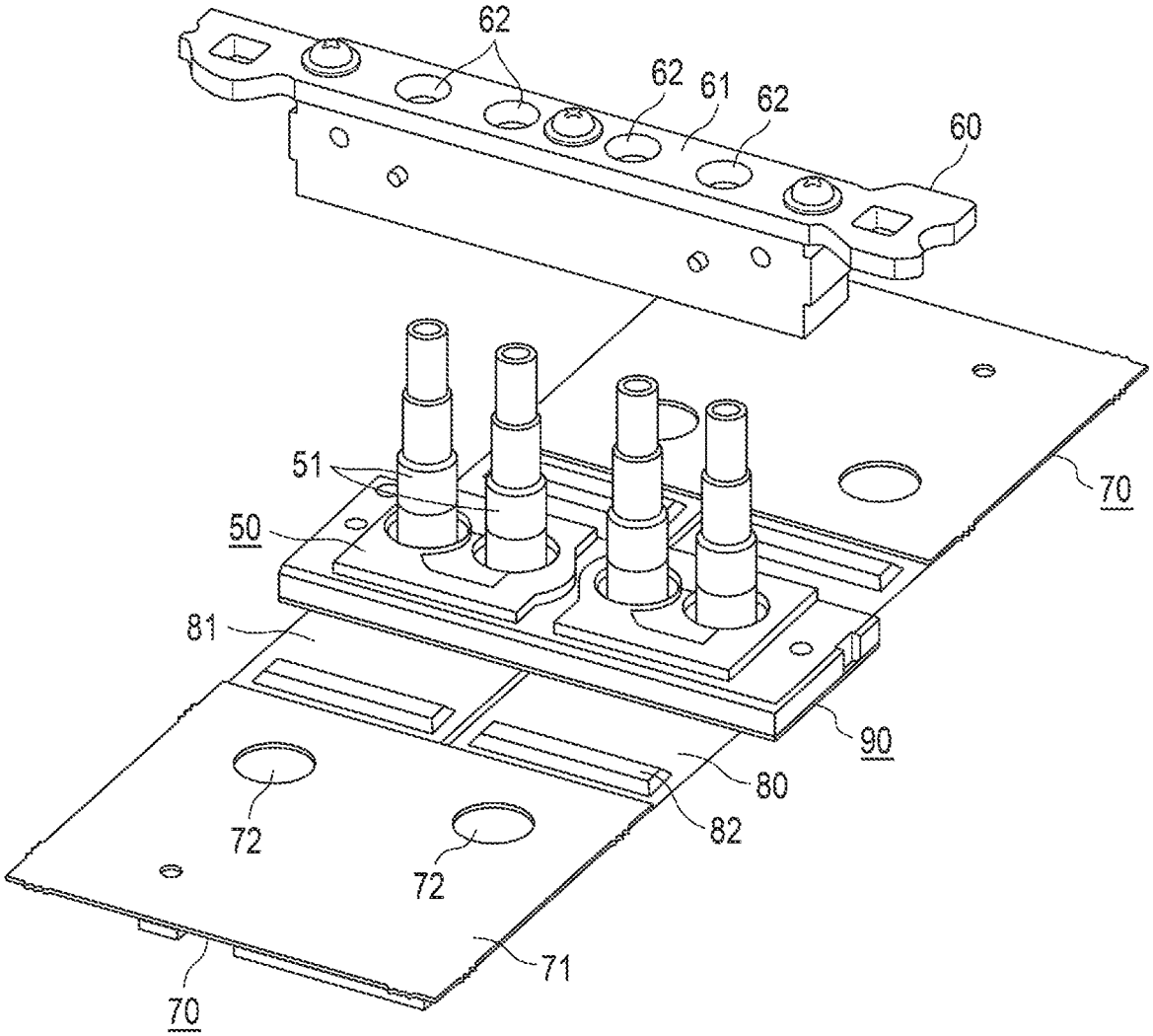
FIGS. 6-10 each illustrate a perspective view of the inkjet head to illustrate an assembly process of the inkjet head.

The inkjet head 10 configured as such is assembled as follows. In other words, as illustrated in FIG. 6, the wiring film 80 is mounted on the head plate 91. The printed wiring board 70 is connected to the wiring film 80. The manifold 92 is attached to the head plate 91. The connecting portion 51 is attached to the manifold 92. The connecting portion 51 is passed through the opening hole 62 of the reference plate 60.

Figure 7:
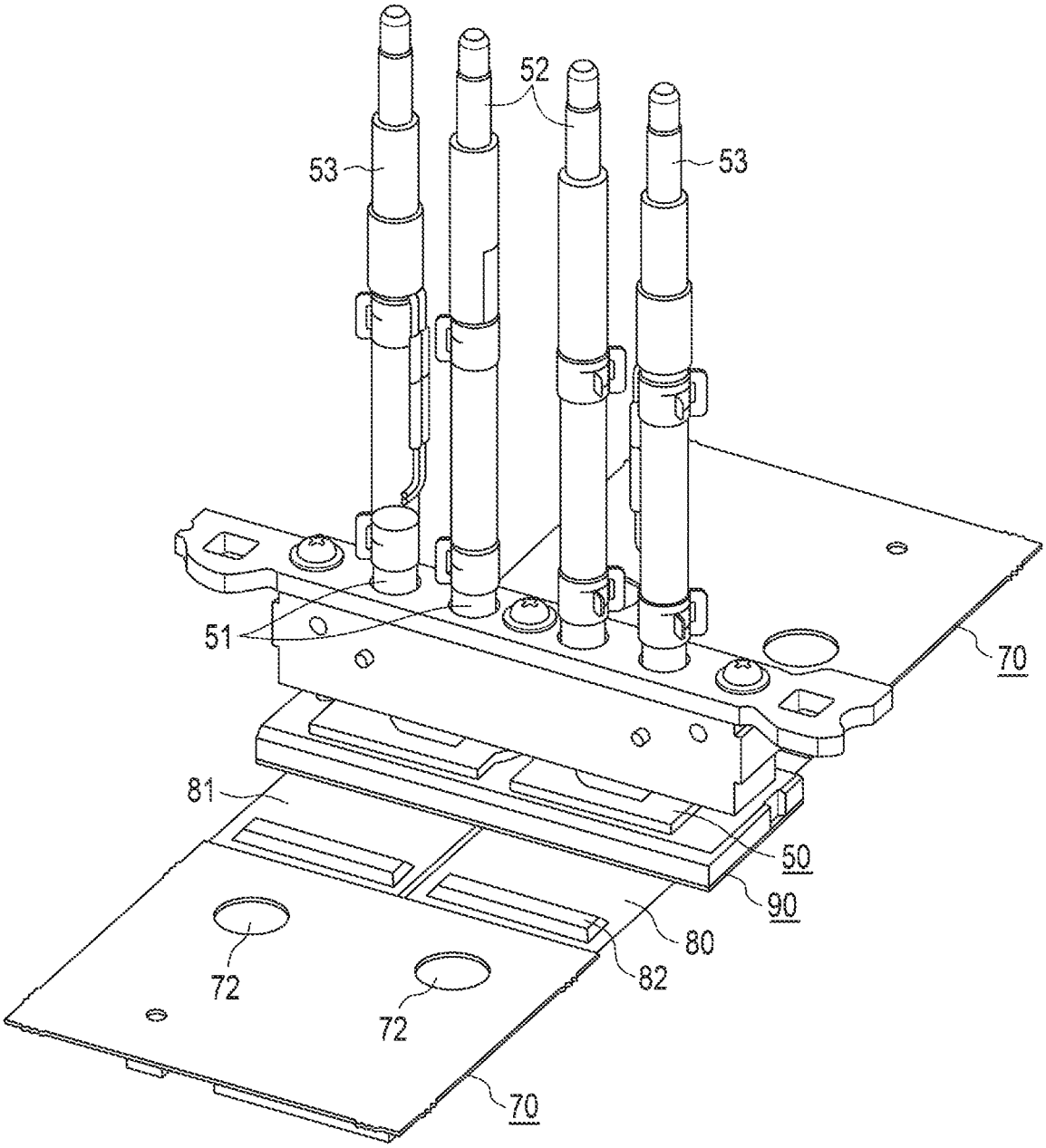
Figure 8:
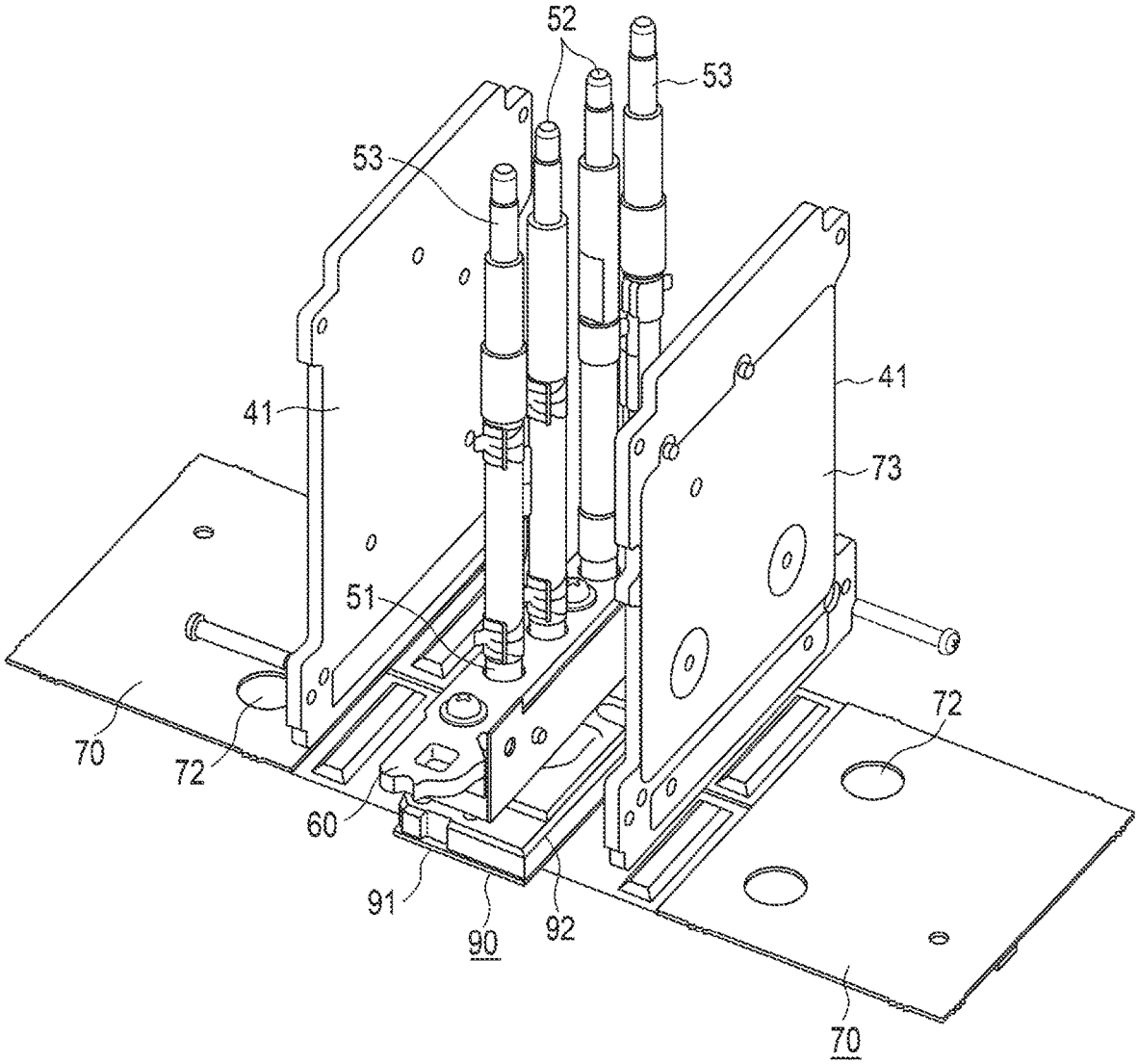

Then, as illustrated in FIG. 7, the ink supply tube and the ink discharge tube 53 are attached to the connecting portion 51. Next, as illustrated in FIG. 8, the inner plate 41 is fixed to the reference plate 60. Then, as illustrated in FIG. 9, the printed wiring board 70 is attached to the inner plate 41. The flat cable 75 is connected to the communication terminal 74 of the printed wiring board 70.

Figure 10:
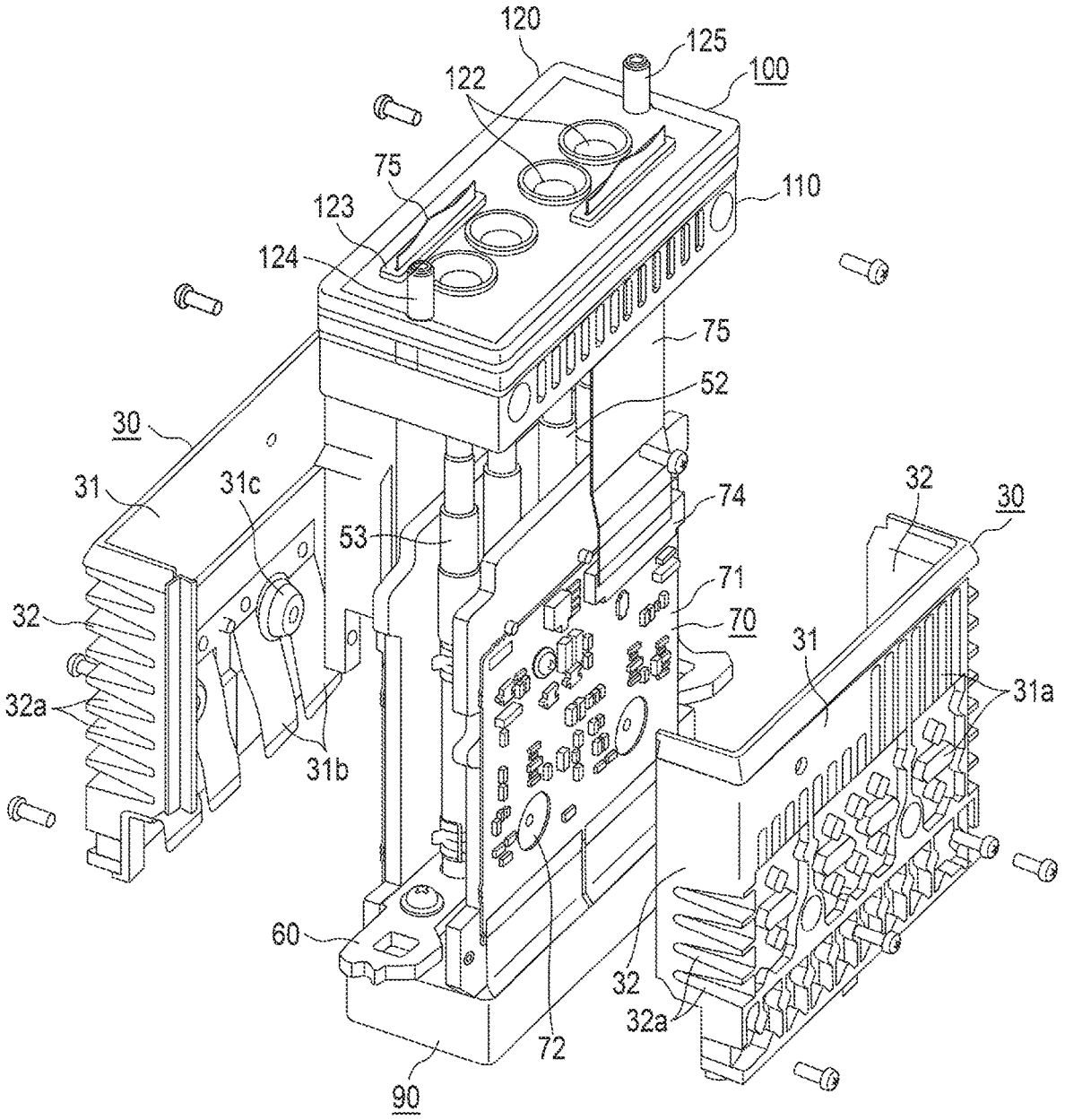

Then, as illustrated in FIG. 10, the inner plate 41, the ink supply tube 52, the ink discharge tube 53, and the flat cable 75 are passed through the inner wall surface 111 side of the cooling unit 100. The side covers 30 are combined with each other. Here, the protruding portion 31*c* of the side cover 30 is fit to the inner plate 41 from the hole portion 72 and then screwed. The leaf spring 31*b* presses the driving control IC 82 towards the inner plate 41.

The inkjet head 10 assembled as such is subjected to printing and cooling as follows. In other words, when a print command is input from the outside, the driving control IC 82 starts to control the pressure chamber of the head plate 91, and discharges ink supplied from the ink supply tube 52 towards a recording medium S (see FIG. 14). Here, the driving control IC 82 generates heat. The heat of the driving control IC 82 is transferred to the inner plate 41 in direct contact with the driving control IC 82. The heat transferred to the inner plate 41 is diffused upward as indicated by a broken line H in FIG. 5. The inner plate 41 contacts the protruding portion 31*c* of the side cover 30, and the heat is transferred to the side covers 30. Since the inner plate 41 and the side covers 30 are in contact with each other at the shortest distance by the hole portion 72, a heat transfer efficiency may be improved.

Meanwhile, an upper end of the inner plate 41 is connected to the cooling unit 100. The coolant flows through the cooling unit 100 to cool the inner plate 41. A temperature of the ink flowing through the ink discharge tube 53 is detected by a temperature sensor, and a flow rate of the coolant is adjusted to maintain the temperature in a certain range or at a certain value. In other words, even if heat generation of the driving control IC 82 is increased, a cooling efficiency is increased and the temperature may be stabilized.

As described above, heat transferred from the driving control IC 82 to the inner plate 41 is dissipated by air-cooling via the side covers 30 and, at the same time, by the cooling unit 100. Accordingly, a high heat dissipation effect may be obtained. Thus, it is possible to prevent a defect caused by overheating of the driving control IC 82, maintain a relative position of the discharge unit 90 with respect to the reference plate 60 with high accuracy, and prevent deterioration of print quality caused by increase in viscosity of the ink.

In the inkjet head 10 according to the current embodiment, heat from the driving control IC 82 may be effectively dissipated. Accordingly, a printing speed may be increased. Also, it is possible to accurately position the discharge unit 90. In particular, in a printer with a plurality of inkjet heads 10, variations in the positional relationship between the different inkjet heads 10 may be prevented. Accordingly, it is possible to improve the printing quality.

Second Embodiment

Figure 11:
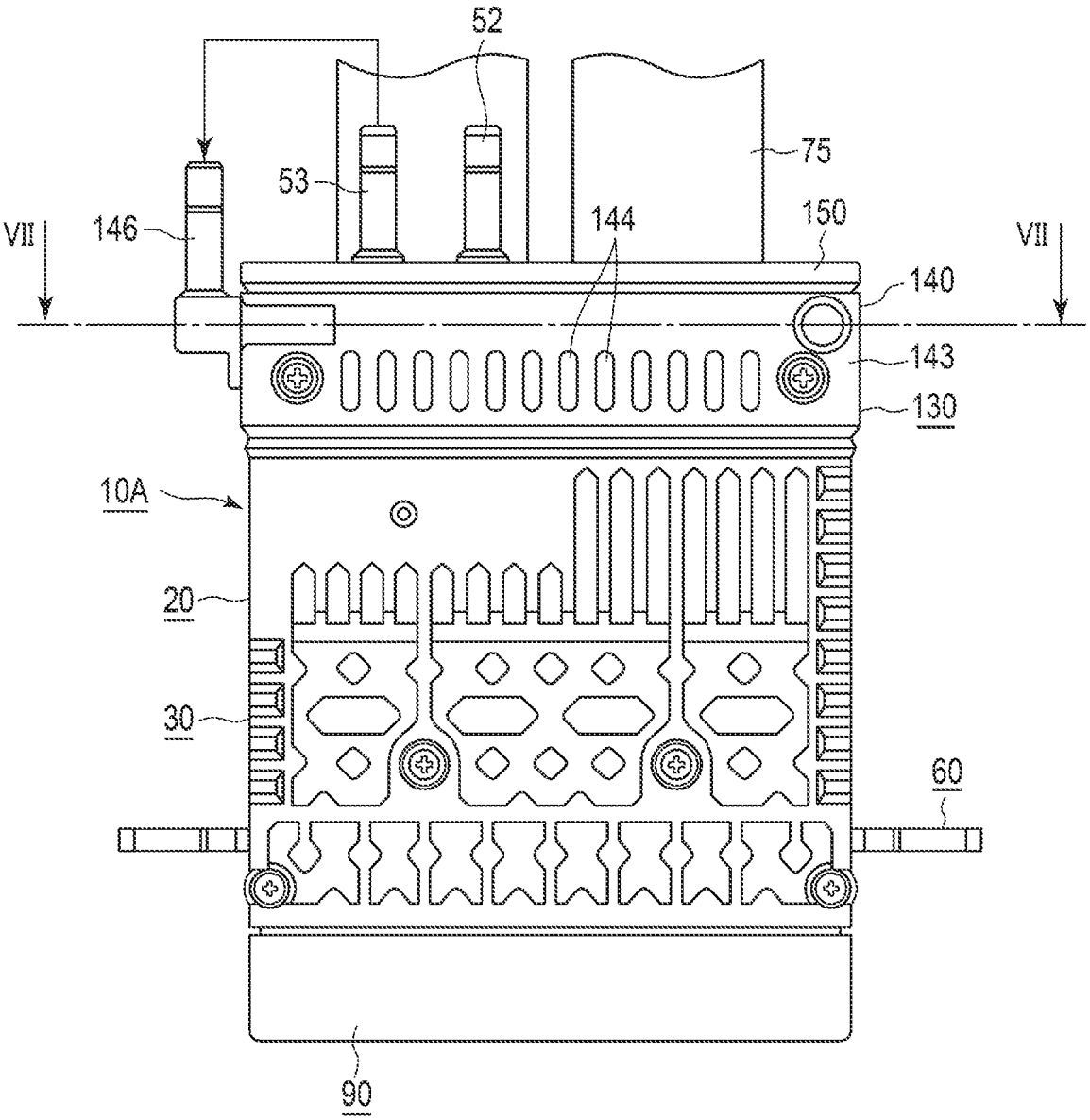
FIG. 11 illustrates a front view of an inkjet head according to a second embodiment.
Figure 12:
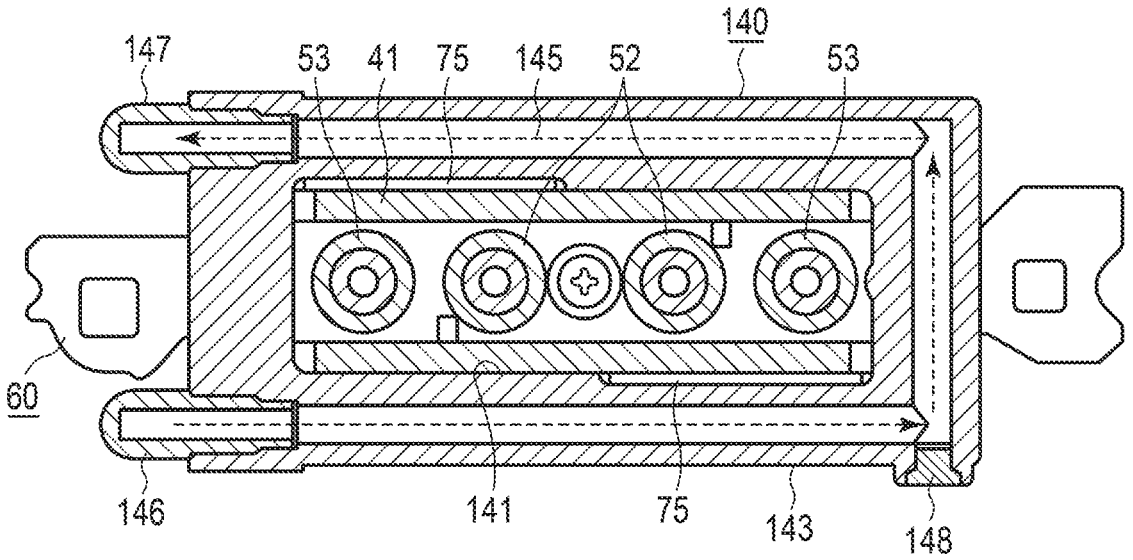
FIG. 12 illustrates a cross-sectional view taken along a line VII-VII of FIG. 11 and viewed in arrow direction.
Figure 13:
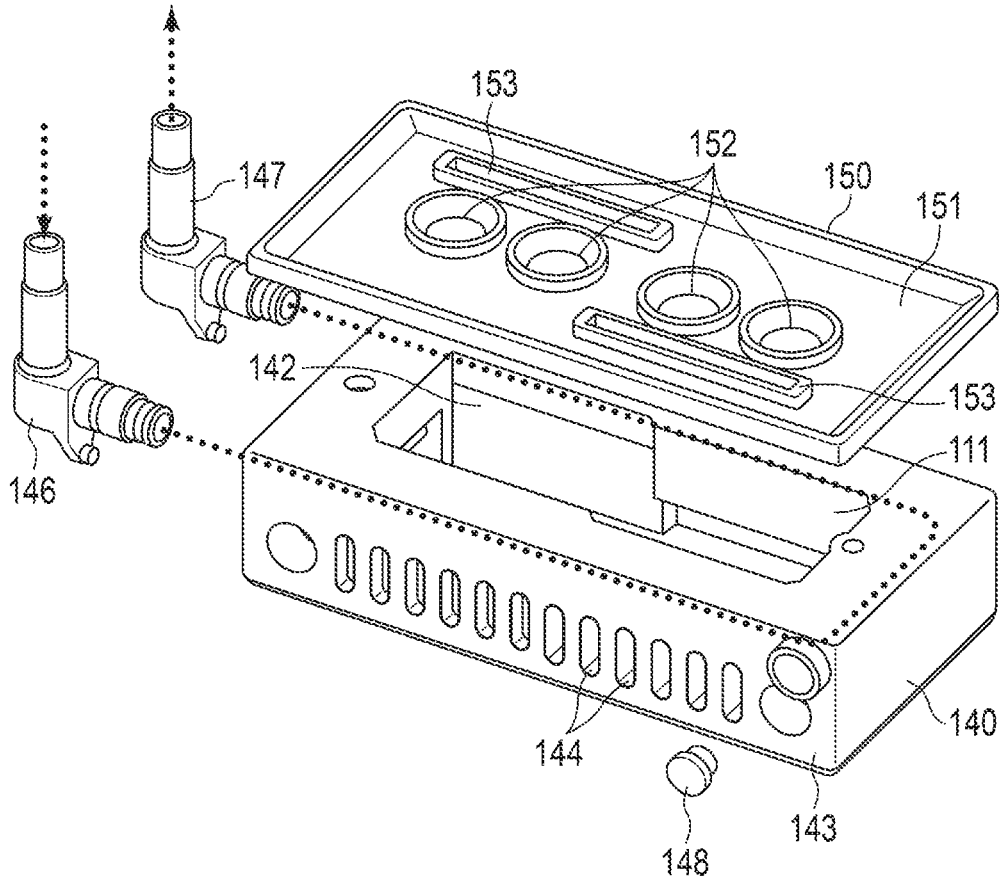
FIG. 13 illustrates an exploded perspective view of a cooling mechanism of the inkjet head.

Next, an inkjet head 10A according to a second embodiment will be described with reference to FIGS. 11 to 13. FIG. 11 illustrates a front view of the inkjet head 10A. FIG. 12 illustrates a cross-sectional view of the inkjet head 10A taken along a line VII-VII of FIG. 11 and viewed in arrow direction. FIG. 13 illustrates an exploded perspective view of a cooling unit 130 in the inkjet head 10A. In the drawings, the same functional components as those in FIGS. 1 to 10 are denoted by the same reference numerals, and detailed descriptions thereof are omitted.

The cooling unit 130 includes a housing 140 having a rectangular frame shape and a top cover 150 covering an upper surface side of the housing 140. Both the housing 140 and the top cover 150 are preferably formed of a material having high thermal conductivity, such as aluminum, magnesium, or ceramic.

A recessed portion 142 is formed on an inner wall surface 141 of the housing 140. An upper end portion of the inner plate 41 is in contact with the inner wall surface 141. The flat cable 75 is positioned in the recessed portion 142. Cooling fins 144 are formed on an outer wall surface 143 of the housing 140. A flow path 145, through which coolant flows, is formed inside the housing 140. The flow path 145 in this example is three long holes that do not penetrate the housing 140. A coolant inlet port 146 and a coolant outlet port 147 are formed at end portions of the flow path 145. It is noted that a hole that is not directly connected to a pipe or the like can be closed (sealed against liquids) by a plug 148. The coolant supplied from the coolant inlet port 146 passes through the flow path 145 and is discharged from the coolant outlet port 147.

The top cover 150 includes a plate 151. The plate 151 includes holes 152 through which two sets of ink supply tubes 52 and ink discharge tubes 53 pass. A slit hole (slot) 153 through which the flat cable 75 passes is formed.

The inkjet head 10A according to the current embodiment may have the same effects as the first embodiment.

Figure 14:
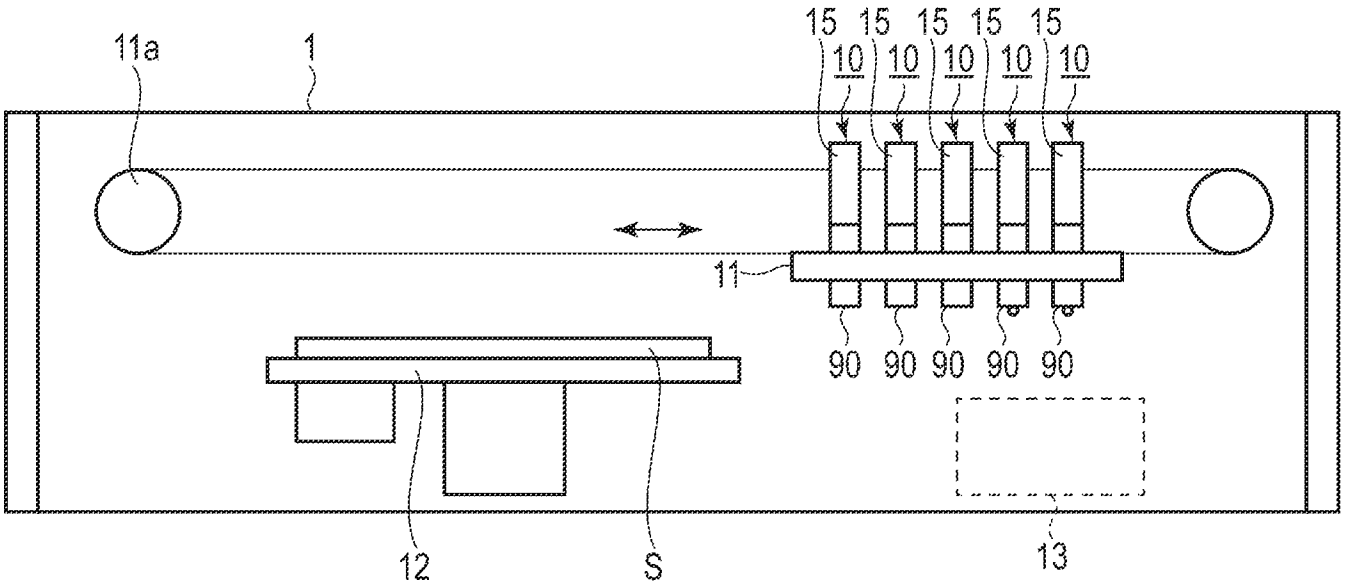
FIG. 14 is a diagram illustrating a printer including an inkjet head according to an embodiment.

The printer 1 illustrated in FIG. 14 includes a plurality of inkjet heads 10, a head support mechanism 11 that supports the inkjet heads 10 and permits movement in a direction indicated by arrows in the drawings, a medium support mechanism 12 that supports the recording medium S permits movement of the recording medium S, and a host control device 13.

As illustrated in FIG. 14, the plurality of inkjet heads 10 are arranged in parallel to each other in a certain direction and are supported by the head support mechanism 11. The host control device 13 causes a carriage 11*a* provided in the head support mechanism 11 to reciprocate the recording medium S in the direction indicated by the arrows in FIG. 14. The inkjet head 10 integrally includes an ink circulation mechanism 15 for recovering and supplying ink by circulating the ink. The inkjet head 10 discharges liquid, for example, ink, from the discharge unit 90, thereby forming a desired image on the recording medium S arranged opposite thereto.

The present disclosure is not limited by the above described example embodiments. For example, in the above embodiments, the insulating film 73 is a graphite sheet, but another material may be used so long as the material has both insulating property and heat transfer property. The inkjet head 10 includes two sets of ink supply tubes 52 and ink discharge tubes 53, but the inkjet head 10 may include one set of ink supply tube 52 and ink discharge tube 53, or three sets of ink supply tubes 52 and ink discharge tubes 53. The ink supply tubes 52 and the ink discharge tubes 53 do not need to be paired. For example, the ink supply tube 52 may be a single conduit.

The printer 1 can be an inkjet printer that forms a two-dimensional image on a recording medium S with ink. However, the disclosure is not limited thereto. For example, the printer 1 may be a 3D printer, an industrial manufacturing machine, a medical machine, or the like. When the printer 1 is a 3D printer, an industrial manufacturing machine, a medical machine, or the like, a 3D object may be formed by discharging, for example, a material or a binder for solidifying a material from the liquid discharge head.

The printer 1 of an embodiment includes five inkjet heads 10, and ink colors used by each inkjet head 10 are cyan, magenta, yellow, black, and white, respectively. However, the number of inkjet heads 10 is not limited to five, and may be any number. Furthermore, the colors and characteristics of inks used by each inkjet head 10 are not limited.

An inkjet head 10 may discharge transparent gloss ink, ink that develops a color when irradiated by infrared rays, ultraviolet rays, or the like, or other special ink types. The inkjet head 10 may be capable of discharging a liquid other than ink. The liquid discharged by the inkjet head 10 may be dispersed liquid such as suspension or the like. Examples of liquid other than ink discharged by the inkjet head 10 include liquid containing conductive particles for forming a wiring pattern on a printed circuit board, liquid containing cells for artificially forming a tissue, an organ, or the like, a binder such as an adhesive, wax, liquid resin, and the like.

While certain embodiments have been described, these embodiments have been presented by way of example only, and are not intended to limit the scope of the present disclosure. Indeed, the novel embodiments described herein may be embodied in a variety of other forms; furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. A liquid discharge head, comprising:

a head including a plurality of discharge holes for discharging liquid;

a liquid supply conduit through which liquid is supplied to the head for discharge;

a liquid discharge conduit through which liquid from the head flows if not discharged;

a radiator including a flow path through which a coolant flows, the coolant being a liquid different from the liquid supplied to the head for discharge;

a first wiring board between the head and the radiator and having a connector connected to a wiring extending through an interior of the radiator;

a second wiring board between the head main body and the first wiring board;

a driving control element on the second wiring board and configured to control liquid discharge from the discharge holes; and a heat conductive member extending between the head and the radiator, and in thermal contact with the radiator.

2. The liquid discharge head according to claim 1, further comprising:

an elastic body urging the driving control element toward the heat conductive member.

3. The liquid discharge head according to claim 2, further comprising:

an exterior cover covering the heat conductive member, wherein the elastic body is disposed between the driving control element and an inner surface of the cover.

4. The liquid discharge head according to claim 1, wherein the liquid supply conduit and the liquid discharge conduit pass through the radiator.

5. The liquid discharge head according to claim 1, wherein the coolant comprises an aqueous liquid.

6. The liquid discharge head according to claim 1, wherein an inlet and an outlet of the radiator extend along the liquid supply conduit and the liquid discharge conduit.

7. The liquid discharge head according to claim 1, wherein a plurality of flow paths is formed between an inlet and an outlet of the radiator.

8. The liquid discharge head according to claim 1, wherein an inlet and an outlet of the radiator are disposed at a side surface of the radiator.

9. The liquid discharge head according to claim 1, wherein the flow path of the radiator is formed around the interior thereof.

10. The liquid discharge head according to claim 1, wherein the radiator includes a plurality of fins along at least a part of the flow path.

11. The liquid discharge head according to claim 1, further comprising:

an electrical insulating film between the heat conductive member and the first wiring board.

12. The liquid discharge head according to claim 1, wherein the first wiring board is a non-flexible wiring board, and, the second wiring board is a flexible wiring board.

13. A liquid discharge apparatus comprising:

a liquid discharge head including:

a head including a plurality of discharge holes for discharging liquid;

a liquid supply conduit through which liquid is supplied to the head for discharge;

a liquid discharge conduit through which liquid from the head flows if not discharged;

a radiator including a flow path through which a coolant flows, the coolant being a liquid different from the liquid supplied to the head for discharge;

a first wiring board between the head and the radiator and having a connector connected to a wiring extending through an interior of the radiator;

a second wiring board between the head main body and the first wiring board;

a driving control element on the second wiring board and configured to control liquid discharge from the discharge holes; and a heat conductive member extending between the head and the radiator, and in thermal contact with the radiator; and a liquid circulator configured to supply liquid to the liquid supply conduit and recover liquid from the liquid discharge conduit.

14. The liquid discharge apparatus according to claim 13, wherein the coolant comprises an aqueous liquid.

15. The liquid discharge apparatus according to claim 13, wherein the liquid discharge head further includes an elastic body urging the driving control element toward the heat conductive member.

16. The liquid discharge apparatus according to claim 15, wherein the liquid discharge head further includes an exterior cover covering the heat conductive member, and the elastic body is between the driving control element and an inner surface of the cover.

17. An inkjet apparatus comprising:

a medium holder;

a liquid discharge head including:

a head including a plurality of discharge holes for discharging liquid;

a liquid supply conduit through which liquid is supplied to the head for discharge;

a liquid discharge conduit through which liquid from the head flows if not discharged;

a radiator including a flow path through which a coolant flows, the coolant being a liquid different from the liquid supplied to the head for discharge;

a first wiring board between the head and the radiator and having a connector connected to a wiring extending through an interior of the radiator;

a second wiring board between the head main body and the first wiring board;

a driving control element on the second wiring board and configured to control liquid discharge from the discharge holes; and a heat conductive member extending between the head and the radiator, and in thermal contact with the radiator;

a liquid circulator configured to supply liquid to the liquid supply conduit and recover liquid from the liquid discharge conduit; and a carriage mechanism configured to move the liquid discharge head relative to the medium holder.

18. The inkjet apparatus according to claim 17, wherein the coolant comprises an aqueous liquid.

19. The inkjet apparatus according to claim 17, wherein the liquid discharge head further includes an elastic body urging the driving control element toward the heat conductive member.

20. The inkjet apparatus according to claim 19, wherein the liquid discharge head further includes an exterior cover covering the heat conductive member, and the elastic body is between the driving control element and an inner surface of the cover.

* * * * *